US005197182A

United States Patent [19]

Mizuo

[11] Patent Number: 5,197,182

[45] Date of Patent: Mar. 30, 1993

[54] APPARATUS FOR MANUFACTURING AN ELECTRIC CABLE

[76] Inventor: Yasuhiko Mizuo, 5-29-7 Honta, Kokubunji-shi, Tokyo, Japan

[21] Appl. No.: 739,830

[22] Filed: Jul. 31, 1991

[30] Foreign Application Priority Data

Aug. 22, 1990 [JP] Japan ..... 2-220703

[51] Int. Cl.[5] ..... H01B 13/22

[52] U.S. Cl. ..... 29/745; 29/828; 29/868; 156/54

[58] Field of Search ..... 29/745, 828, 868, 872, 29/728; 156/47, 50, 54

[56] References Cited

U.S. PATENT DOCUMENTS 3,126,044 3/1964 Riso ..... 29/728 X
3,633,261 1/1972 Grabe ..... 156/54
4,753,002 6/1988 Chabane et al. ..... 29/828 X

*Primary Examiner*—Carl E. Hall
*Attorney, Agent, or Firm*—Helfgott & Karas

[57] ABSTRACT

An apparatus for manufacturing an electric cable comprises a flexible belt on which a plurality of longitudinal projections are formed, a motor to move the flexible belt at the same speed as a cable core covered with an insulating layer, and a forming unit including a plurality of rolls to form a conductive tape having a wavy pattern around the cable core. The conductive tape is formed around the cable core by a radial directional force applied by the rolls via the projections to the flexible belt, when the cable core and the conductive tape are passed through the forming rolls together with the flexible belt. Consequently, the conductive tape is able to be formed around the insulating layer of the cable core while maintaining the shape of the wavy pattern.

5 Claims, 7 Drawing Sheets

APPARATUS FOR MANUFACTURING AN ELECTRIC CABLE

FIELD OF THE INVENTION

This invention relates to an apparatus for manufacturing an electric cable, and more particularly to an apparatus for manufacturing an electric cable, in which a conductive tape having a wavy or corrugated pattern is formed around an insulation layer of a cable core.

BACKGROUND OF THE INVENTION

Recently, compact electric devices have been required in which a cable employed therein should have high flexibility. Therefore, a conductive tape having a wavy, corrugated and/or embossed pattern (defined a "wavy pattern"0 hereinafter) has been utilized for a shielding layer of an electric cable or an outer conductor of a coaxial cable.

In a conventional apparatus for manufacturing an electric cable, a cable core is inserted into a forming die with a conductive tape, and the cable core is drawn from the die together with the conductive tape, so that the conductive tape is formed around the cable core. In such an apparatus, the conductive tape is advanced by a guide belt independently of the cable core to relief the conductive tape from tension, so that the conductive tape is prevented from losing a wavy pattern formed thereon.

According to the conventional apparatus, however, there is a disadvantage in that tension of the conductive tape in the longitudinal direction thereof is not avoided sufficiently, because a difference in an advancing speed between the cable core and the guide belt occurs due to by friction between the guide belt and the inner surface of the die. Then, the conductive tape is twisted and pressured in the radial direction, so that the wavy pattern of the conductive tape is crushed. Therefore, the manufactured cable did not have good electrical and mechanical characteristics.

SUMMARY OF THE INVENTION

Accordingly, it is an object of the invention to provide an apparatus for manufacturing an electric cable in which a conductive tape having a wavy pattern is able to be formed around an- insulation layer of a cable core whilst retaining the shape of the wavy pattern.

According to the invention, an apparatus for manufacturing an electric cable comprises:

means for advancing a cable core covered with an insulation layer at a predetermined speed;

means for supplying a conductive tape having a wavy pattern;

a flexible belt having a plurality of longitudinal projections formed on one surface thereof, and being in contact with the conductive tape at the other surface thereof;

means for carrying the flexible belt along the cable core at the same speed as the cable core; and means for forming the conductive tape around the cable core;

wherein the forming means comprises a plurality of forming rolls which support the flexible belt to engage with the plurality of projections, and the conductive tape is formed by the rolls to surround the cable core by a radial directional force applied via the projections to the flexible belt when the cable core and the conductive tape are passed through the forming rolls together with the flexible belt.

BRIEF DESCRIPTION OF THE DRAWINGS u

The invention will be explained in more detail in conjunction with appended drawings, wherein.

DESCRIPTION OF THE PREFERRED EMBODIMENTS

Figure 1:
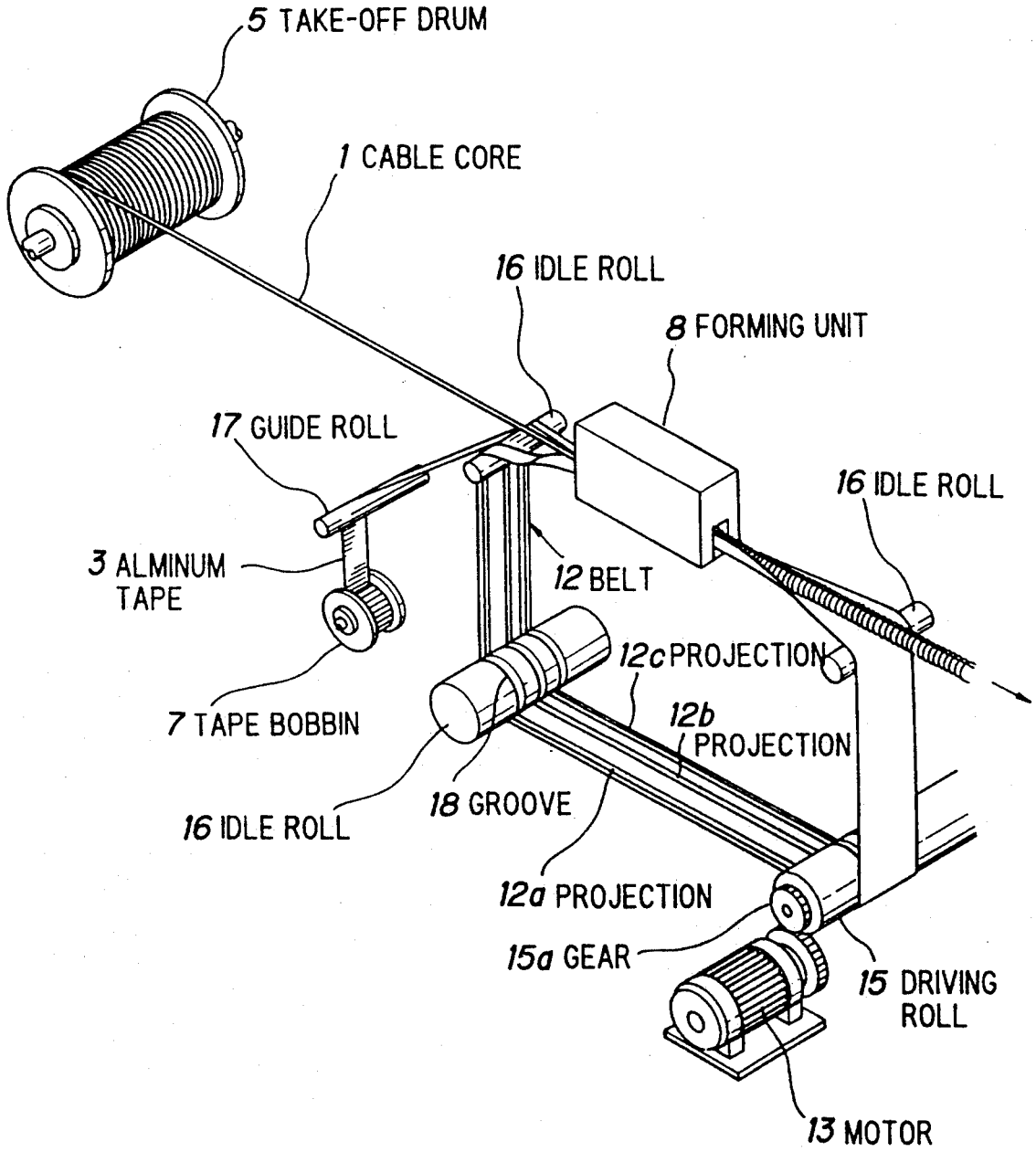
FIG. 1 is a perspective view illustrating an apparatus for manufacturing an electric cable of a first preferred embodiment according to the invention.
Figure 2:
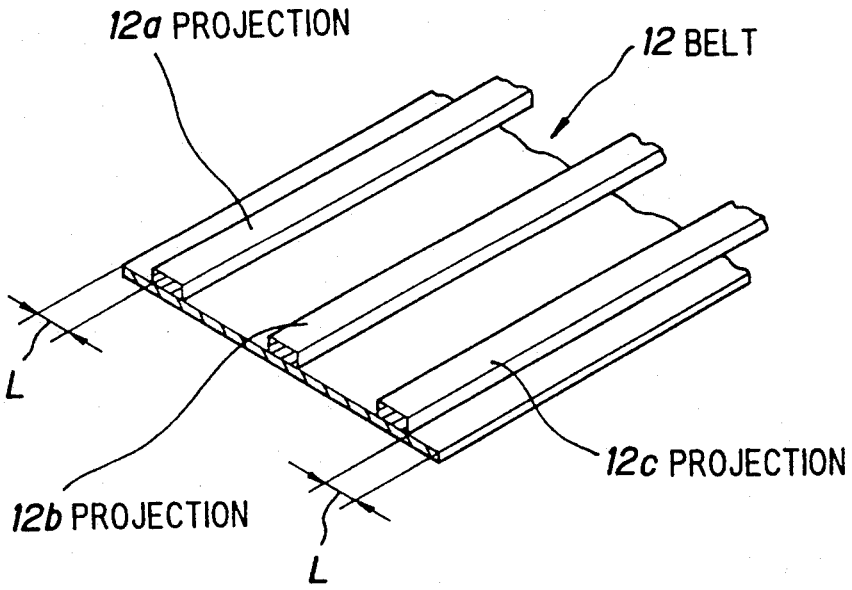
FIG. 2 is a perspective view illustrating a part of a belt of the first preferred embodiment shown in FIG. 1.

FIG. 1 shows an apparatus for manufacturing an electric cable of a first preferred embodiment according to the invention, and FIG. 2 shows a part of a belt in FIG. 1. The apparatus for manufacturing an electric cable comprises a take-off drum 5 around which a cable core 1 covered with an insulating layer (not shown) is wound, a tape bobbin 7 around which an aluminum tape 3 having a wavy pattern thereon is wound, a forming unit 8 which forms the aluminum tape 3 around the cable core 1, a belt 12 which forces the aluminum tape 3 to move forward, a motor 13 which advances the belt 12 via a gear 15*a* and a driving roll 15, three idle rolls 16 which guide the belt 12 along a circulation path, and a guide roll 17 which supports the aluminum tape 3.

In this apparatus, the cable core 1 is supplied from the take-off drum 5 to the forming unit at a predetermined speed. The tape bobbin 7 supplies the aluminum tape 3 via the guide roll 17 to the forming unit 8 with a predetermined small tension which is insufficient to cause the collapse of the wavy pattern thereof.

The belt 12 has a high flexibility, a high strength, and a width slightly larger than that of the aluminum tape 3. The belt 12 is provided with three projections 12*a*, 12*b*, and 12*c* on the back surface longitudinally and in parallel as shown in FIG. 2. The projection 12*b* is formed at the center of the belt 12, and the projections 12*a* and 12*c* are formed symmetrically to the projection 12*b* with a short distance L from the edges of the belt 12, respectively. The motor 13 drives the driving roll 15 via the gear 15*a* to carry the belt 12 at the same speed as that of the cable core 1. The driving roll 15 and idle rolls 16 have three parallel grooves 18 in the surfaces thereof, respectively, to receive the projections 12*a* to 12*c* therein, and circulate the belt 12 to give a predetermined tension thereto.

FIGS. 3A to 3E show a construction of the forming unit 8 in which an outer case shown in FIG. 1 is not shown. The forming unit 8 may comprise a plurality of stages, for instance, twenty to thirty stages each including a plurality of rolls. However, only five stages are shown to correspond to FIGS. 3A to 3E, because the five stages are sufficient to explain the function and operation of the unit 8.

Figure 3A:
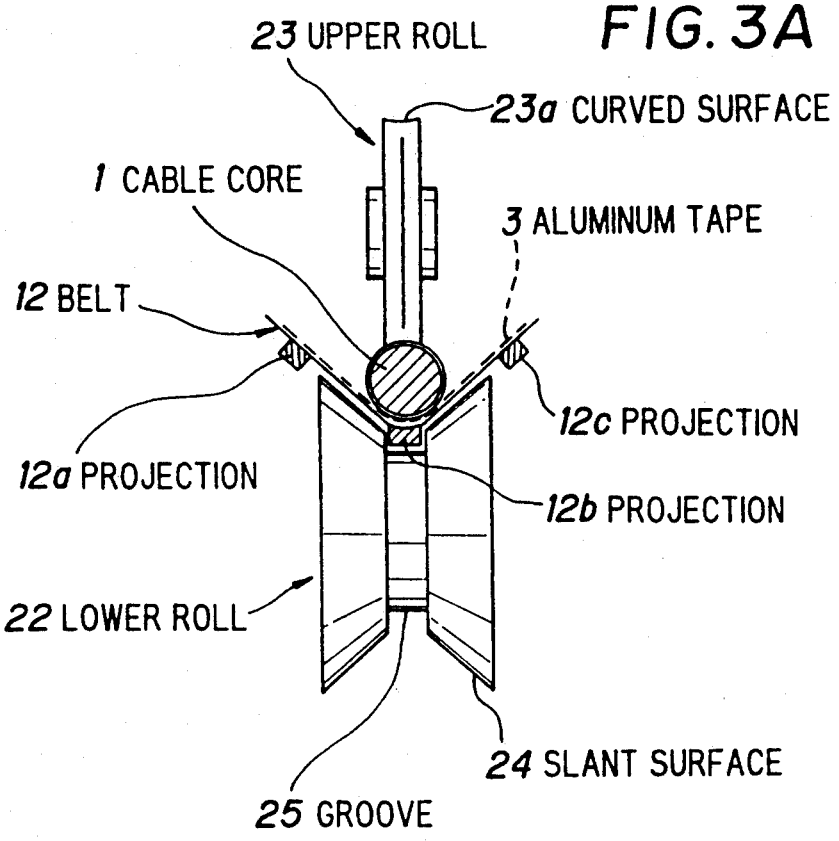
FIGS. 3A to 3E are explanation views showing an operation of the first preferred embodiment.

A first stage shown in FIG. 3A which is provided at a first position of the forming unit 8 consists of a lower roll 22 for upholding the belt 12, and an upper roll 23 for holding down the cable core 1 with a predetermined pressure. The lower roll 22 is shaped to have slant surfaces 24 each contacting the back surface of the belt 12, and a groove 25 into which the projection 12*b* is received. The upper roll 23 is shaped to have a curved surface 23*a* to fit with the cable core 1, and supported to be moved up and down depending on a size of the cable core 1.

Figure 3B:
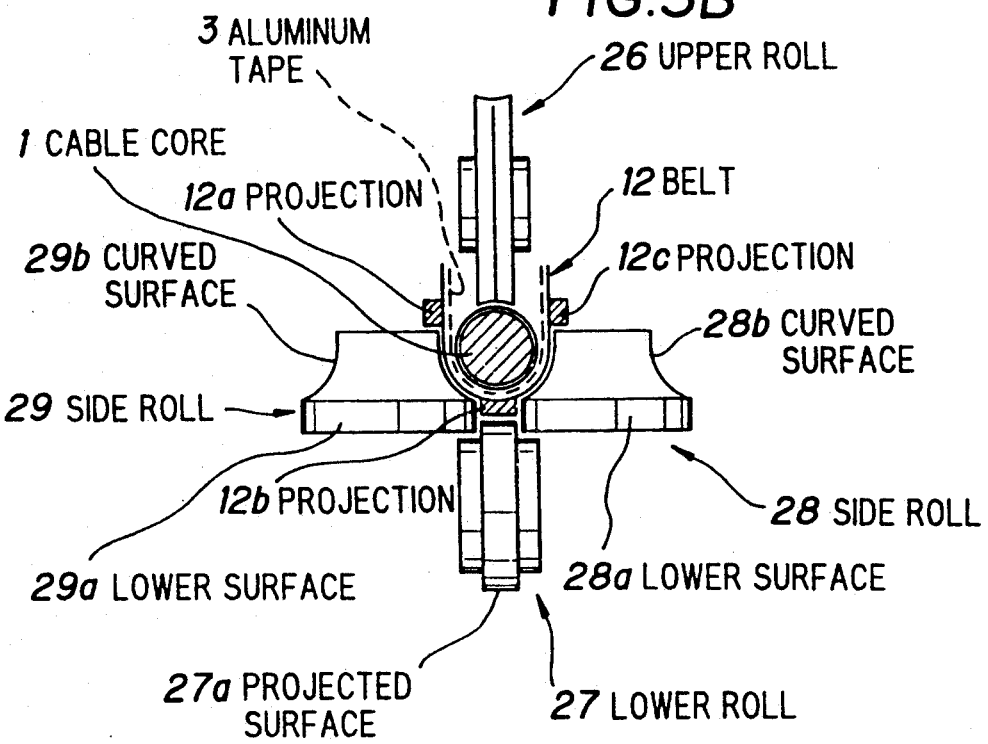

A second stage shown in FIG. 3B which follows the first stage consists of an upper roll 26 corresponding to the roll 23, a lower roll 27 upholding the belt 12, and a pair of side rolls 28 and 29. The lower roll 27 is shaped to have a projected surface 27*a* having approximately the same width as the projection 12*b*. Each side roll 28 and 29 is shaped to have a lower surface 28*a* and 29*a* to support the projection 12*b* in the horizontal direction, and a curved surface 28*b* and 29*b* to curve the belt 12 around the cable core 1.

Figure 3C:
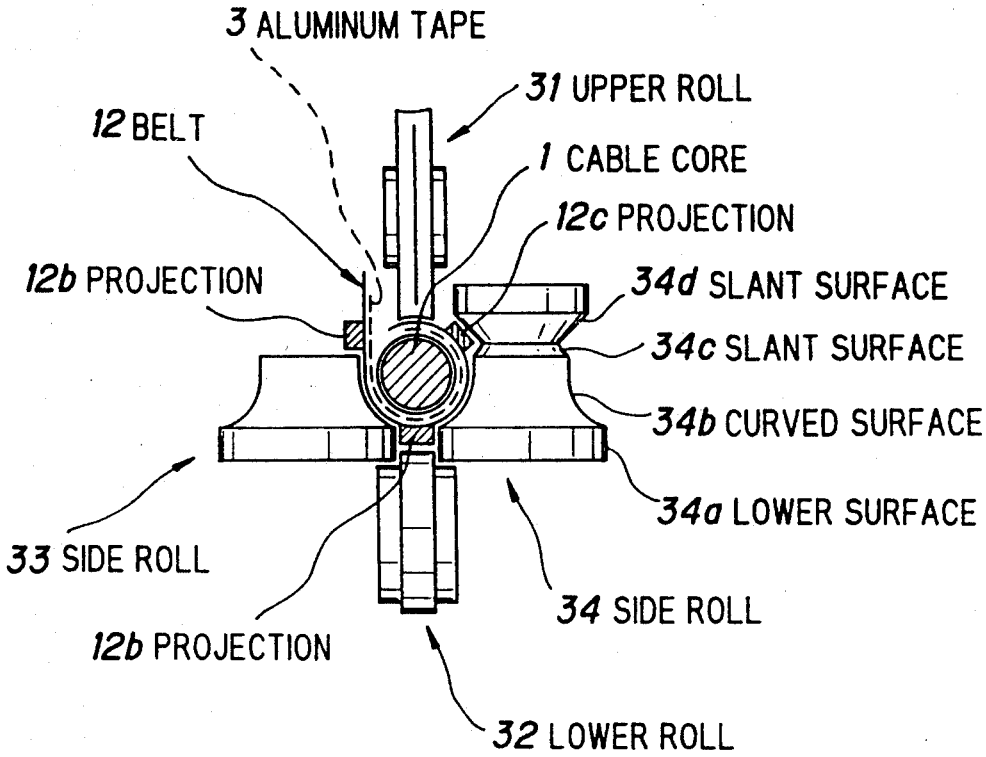

A third stage shown in FIG. 3C which follows the second stage consists of an upper roll 31 corresponding to the roll 23, a lower roll 32 corresponding to the roll 27, a side roll 33 corresponding to the roll 28 and positioned on the left side of the cable core 1, and a side roll 34 positioned on the right side of the cable core 1. The side roll 34 is shaped to have a lower surface 34*a* corresponding to the surface 28*a*, a curved surface 34*b* corresponding to the surface 28*b*, and slant surfaces 34*c* and 34*d* to support the projection 12*c* respectively.

Figure 3D:
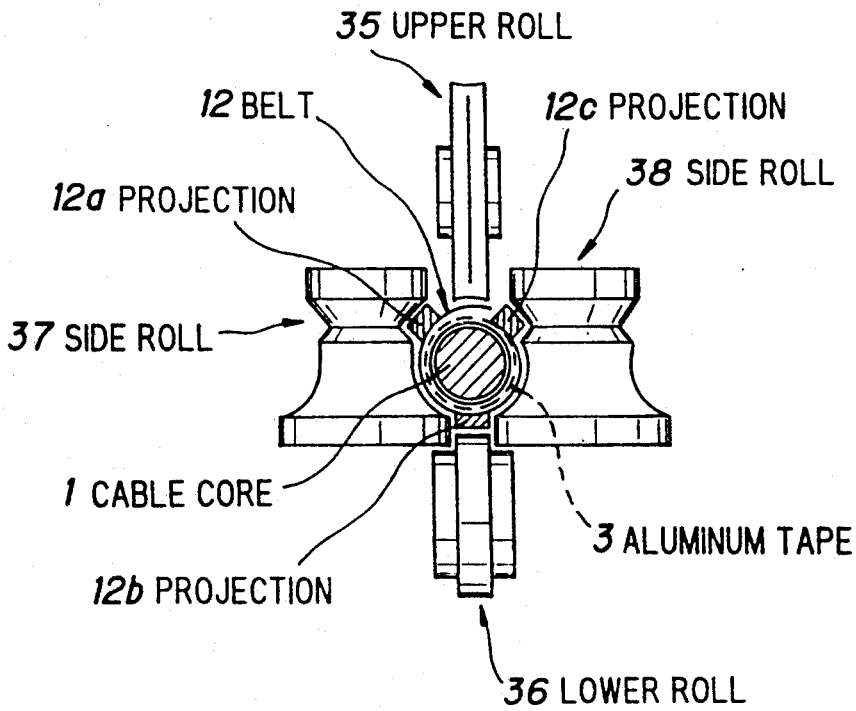

A fourth stage shown in FIG. 3D follows the third stage consists of an upper roll 35 corresponding to the roll 23, a lower roll 36 corresponding to the roll 32, a pair of side rolls 37 and 38 which correspond to the roll 34 and support the projections 12*a* and 12*c* respectively.

Figure 3E:
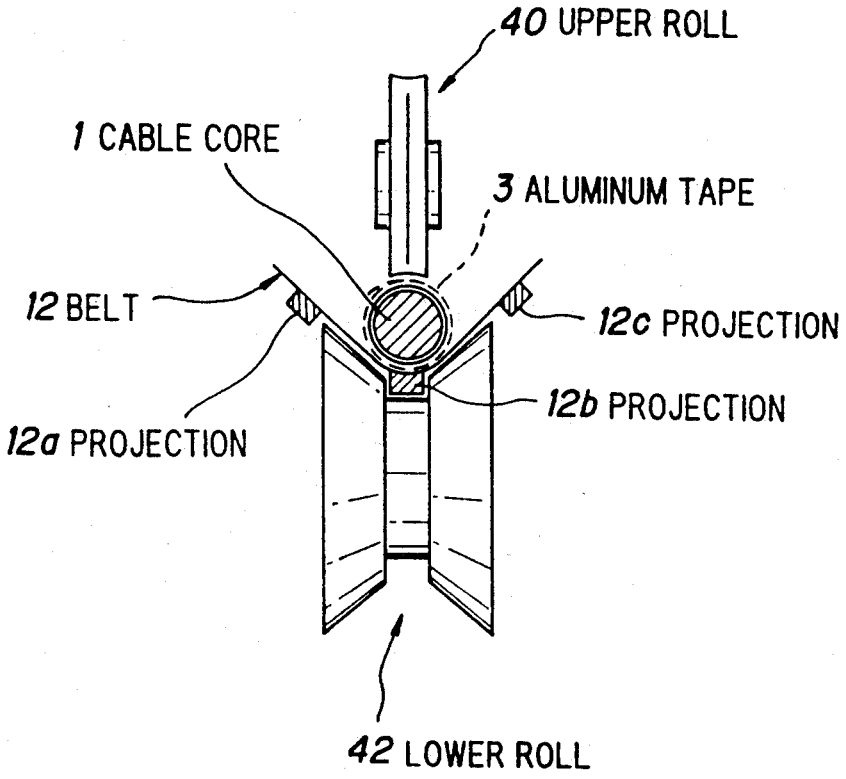

A fifth stage shown in FIG. 3E which is provided at the last position of the forming unit 8 consists of an upper roll 40 and a lower roll 42 of the same construction as the first stage shown in FIG. 3A.

In operation, the aluminum tape 3 is supplied from the tape bobbin 7, and advanced to the forming unit 8 together with the cable core 1 by the belt 12. In the forming unit 8, the belt 12 is slightly curved by the roll set of the first stage shown in FIG. 3A, then the aluminum tape 3 is forced to come into contact with the bottom of the cable core 1 by the belt 12. The belt 12 is further curved to be U-shaped by the roll set of the second stage as shown in FIG. 3B, then the lower half of the cable core 1 is covered with the aluminum tape 3. The right side-half of the belt 12 is further curved by the side roll 34 of the third stage, then three quarters of the outer surface of the cable core 1 are covered with the aluminum tape 3 as shown in FIG. 3C. Next, the belt 12 is curved to cover the entire circumference of the cable core 1 by the roll set of the fourth stage as shown in FIG. 3D, so that the aluminum tape 3 is completely formed to cover the entire surface of the cable core 1. After that, the belt 12 is unfolded to release the aluminum tape 3 at the fifth stage, and the cable core 1 covered with the aluminum tape 3 thus formed is advanced to a stage for a sheath ( not shown ), so that an electric cable is manufactured to have the aluminum tape 3 as a shielding layer or an outer conductor for a coaxial cable.

According to the first preferred embodiment, the projections 12*a* to 12*c* of the belt 12 are supported by the forming rolls 22, 23, and 26 to 42, so that the aluminum tape 3 is stabilized in position to avoid twisting thereof. The aluminum tape 3 is not pressed with excess pressure in the radial direction, so that the aluminum tape 3 is formed uniformly around the cable core 1. The forming rolls 22, 23, and 26 to 42 are rotated by advancing of the belt 12, and no difference in advancing speed between the belt 12 and the cable core 1 occurred, so that the aluminum tape 3 is not subject to any stretch which is otherwise cause by longitudinal tension. Therefore, the aluminum tape 3 is formed on the cable core 1 with maintaining the shape of the wavy pattern, so that a completed cable has high flexibility. The belt 12 is prevented from being caught between the forming rolls, because the projections 12*a* to 12*c* are surrounded by the respective surfaces of the rolls, in particular, the projection 12*b* is encircled by the lower roll 27, 32 or 36 and the side rolls 28 and 29, 33 and 34, or 37 and 38 in the horizontal and vertical directions.

Figure 4A:
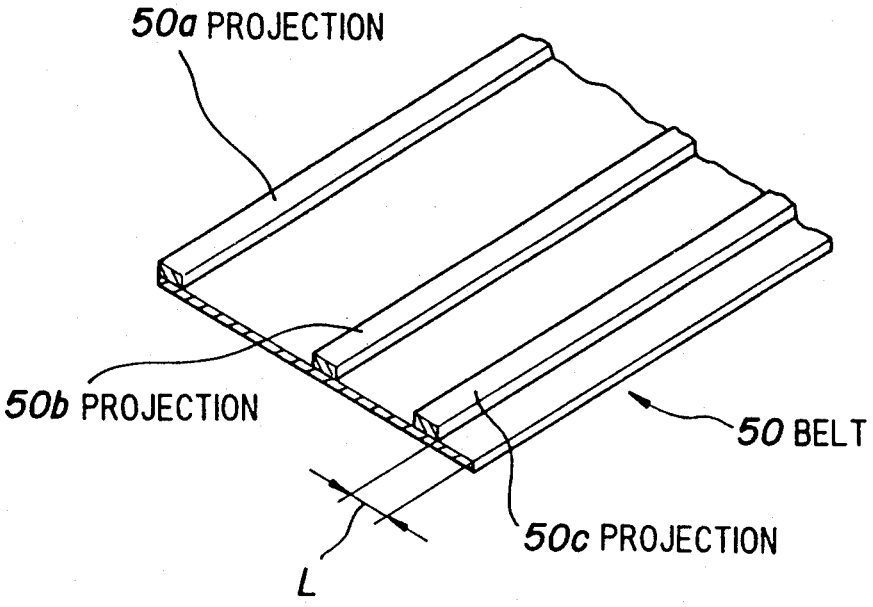
FIG. 4A is a perspective view illustrating a part of a belt of a second preferred embodiment according to the invention.
Figure 4B:
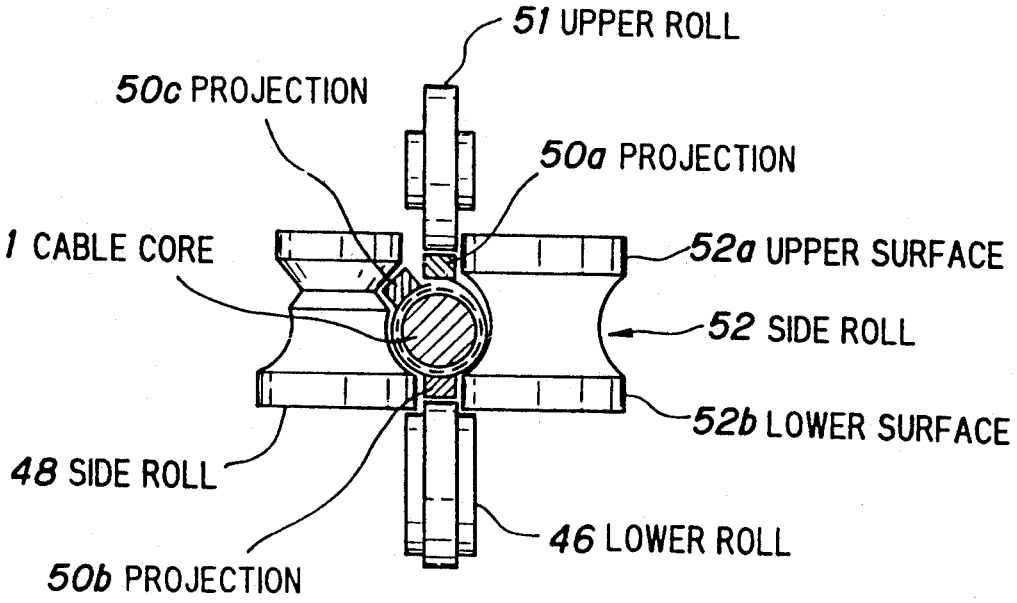
FIG. 4B is an explanation view showing an operation in the preferred embodiment.

Next, an apparatus for manufacturing an electric cable of a second preferred embodiment according to the invention will be explained in connection with FIGS. 4A and 4B wherein FIG. 4A shows belt 50 of forcing the aluminum tape 3 to move forward, and FIG. 4B shows a forming roll set at the fourth stage shown in FIG. 3D. The belt 50 is provided with projections 50*a*, 50*b*, and 50*c*, in which projection 50*a* is formed at one side edge, projection 50*b* is in the center, and projection 50*c* is on the other side in respect to the projection 50*a* with a short distance L from the edge. The forming roll set consists of a lower roll 46 corresponding to the roll 27 the first preferred embodiment, an upper roll 51 for upholding the projection 50*a*, a side roll 48 corresponding to the roll 34 the of first embodiment and positioned on the left side, and a side roll 52 on the right side. The side roll 52 is shaped to be symmetrical at the top-and-bottom, and has an upper surface 52*a* and a lower surface 52*b* for supporting projection 50*a* and projection 50*b*, respectively.

Figure 5A:
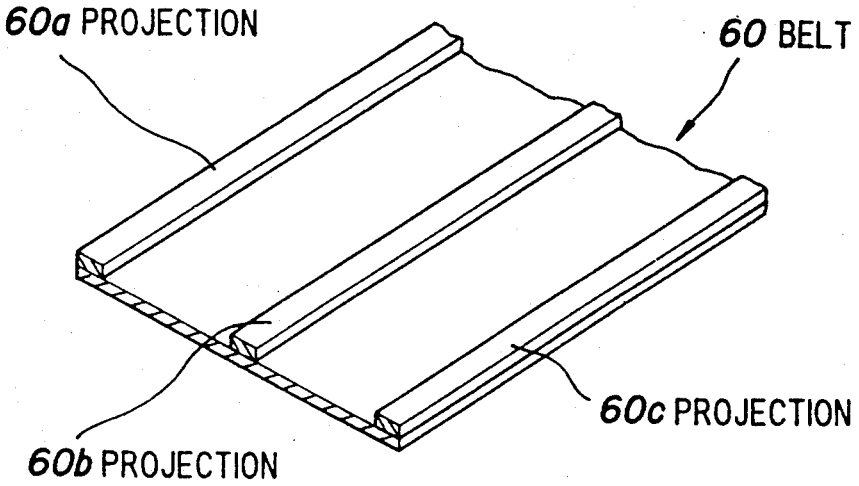
FIG. 5A is a perspective view illustrating a part of a belt of a third preferred embodiment according to the invention.
Figure 5B:
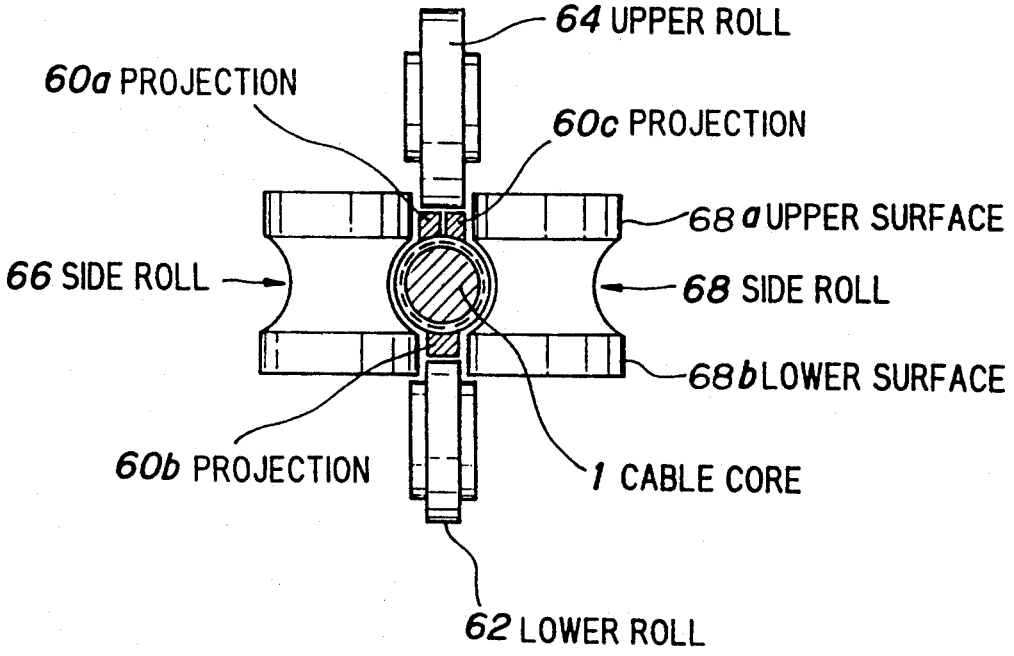
FIG. 5B is an explanation view showing an operation of the third preferred embodiment.

Finally, an apparatus for manufacturing an electric cable of a third preferred embodiment of to the invention will be explained in connection with FIGS. 5A and 5B, wherein FIG. 5A shows a belt 60 for forcing the aluminum tape 3 to move forward, and FIG. 5B shows a forming roll set at the fourth stage shown in FIG. 3D. The belt 60 is provided with projections 60*a* and 60*c* formed at both edges of the belt 60, and a projection 60*b* formed in the center of the belt 60. The forming roll set consists of a lower roll 62 corresponding to the roll 27 in the first preferred embodiment, an upper roll 64 for upholding both of the projections 60*a* and 60*c*, and a pair of side rolls 66 and 68 corresponding to the roll 52 shown in FIG. 4B. According to the third embodiment, the projections 60*a* and 60*c* are formed at both edges of the belt 60, so that simple shaped rolls, such as the roll 68, are employed as forming rolls.

As explained above, according to the second and third preferred embodiments, it is possible to obtain the same effect as the first preferred embodiment.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. An apparatus for manufacturing an electric cable comprising:

means for advancing a cable core covered with an insulation layer at a predetermined speed;

means for supplying a conductive tape having a wavy pattern;

a flexible belt having a plurality of longitudinal projections formed on one surface thereof, and being in contact with said conductive tape at the other surface thereof;

mans for carrying said flexible belt along said cable core at the same speed as said cable core; and means for forming said conductive tape around said cable core;

wherein said forming means includes a plurality of forming rolls which support said flexible belt so as to engage with said plurality of projections, and said conductive tape is formed by said rolls to surround said cable core by a radial directional force applied via said projections to said flexible belt, when said cable core and said conductive tape are passed through said forming rolls together with said flexible belt.

2. An apparatus for manufacturing an electric cable, according to claim 1, wherein:

said plurality of forming rolls comprises a plurality of roll sets provided at a plurality of forming stages along an advancing line of said cable core so that said conductive tape is smoothly formed on said cable core stage by stage by said roll sets.

3. An apparatus for manufacturing an electric cable, according to claim 1 or 2, wherein:

one of said plurality of projections is positioned directly under said cable core, when said flexible belt is passed through said forming rolls and is encircled by said forming rolls in horizontal and vertical directions.

4. An apparatus for manufacturing an electric cable, according to claim 3, wherein:

one of said projections is formed centrally of said flexible belt in a longitudinal direction thereof, and at least one of the other projections is formed at an edge of said flexible belt.

5. An apparatus for manufacturing an electric cable, according to claim 4 wherein:

two of said other projections are formed at opposite edges of said flexible belt.

* * * * *